US006757613B2

(12) United States Patent
Chapman et al.

(10) Patent No.: US 6,757,613 B2
(45) Date of Patent: Jun. 29, 2004

(54) GRAPHICAL METHOD FOR DESIGNING THE TRAJECTORY OF A WELL BORE

(75) Inventors: Clinton D. Chapman, Missouri City, TX (US); Jie Zhang, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 10/028,629

(22) Filed: Dec. 20, 2001

(65) Prior Publication Data

US 2003/0120427 A1 Jun. 26, 2003

(51) Int. Cl.[7] ..... G06F 19/00; G06T 11/20

(52) U.S. Cl. ..... 702/6; 345/442

(58) Field of Search ..... 702/6, 7, 9, 2; 175/45; 703/10, 9, 4, 2; 345/441, 442, 619, 469, 652, 663

(56) References Cited

U.S. PATENT DOCUMENTS

| | | | | |
|---|---|---|---|---|
| 5,821,414 A | * | 10/1998 | Noy et al. | 73/152.54 |
| 5,901,795 A | | 5/1999 | Tsao et al. | |
| 6,025,851 A | * | 2/2000 | Valdes et al. | 345/442 |
| 6,111,588 A | * | 8/2000 | Newell | 345/442 |
| 6,389,360 B1 | * | 5/2002 | Alft et al. | 702/9 |
| 6,441,823 B1 | * | 8/2002 | Ananya | 345/442 |
| 6,523,623 B1 | * | 2/2003 | Schuh | 174/45 |
| 6,577,954 B2 | * | 6/2003 | Alft et al. | 702/9 |

FOREIGN PATENT DOCUMENTS

| | | |
|---|---|---|
| EP | 0 744 526 | 11/1996 |
| WO | WO 00/42287 A1 | 7/2000 |

OTHER PUBLICATIONS

"Derivation of a standard set of geometric constraints for parametric modeling and data exchange", Betting et al., Computer–Aided Design 33 (2001) 17–33.*

Search Report from GB 0228640.9 dated Jun. 3, 2003.

http://www.pathtracker.com/4Planner.cfm (see also related http://www.pathtracker.com/PlanSheetSCurve.cfm)—dated (last updated) Apr. 15, 2000 by archive.org.

http://www.rigzone.com/store/product.asp?p id=214&c id=24—dated Jul. 21, 2001 by archive.org.

* cited by examiner

*Primary Examiner*—John Barlow
*Assistant Examiner*—Toan M. Le
(74) *Attorney, Agent, or Firm*—Kevin P. McEnaney; Brigitte L. Jeffery; John Ryberg

(57) ABSTRACT

The present invention provides a graphical method to design and modify the trajectory of a well bore. A well bore trajectory plan is comprised of hold and curve sections. Hold sections are generally described by specifying the attitude of the hold and the length of the hold. Curve sections can be described and represented in a variety of ways. The present invention introduces control points that are formed at the intersection of extensions/projections of the two hold sections contacting a curve section. The hold sections contact the curve section at tangent points. The tangent points for a curve section have the same distance to the control point. In operation, as a control point is moved, the direction and inclination of multiple sections of the well plan are simultaneously modified. These simultaneous modifications enable the user to quickly and intuitively modify a well plan.

27 Claims, 3 Drawing Sheets

GRAPHICAL METHOD FOR DESIGNING THE TRAJECTORY OF A WELL BORE

FIELD OF THE INVENTION

The present invention provides a method and display for planning the direction and inclination of the trajectory of a well bore and in particular to a method and display for planning the direction and inclination of a well bore trajectory using graphical techniques.

BACKGROUND OF THE INVENTION

Traditional well bore drilling practices attempted to drill wells as near to the vertical as possible. However, over the past 20 years, it has become common to drill directional or slanted wells in order to gain access to hydrocarbon deposits located underneath ground sites, where it was not feasible to set up a drilling rig. Directional drilling is the process of directing the well bore being drilled along a defined trajectory to a predetermined target. Because of these directional drilling capabilities, strong economic and environmental pressures have increased the desire for and use of directional drilling. As a result of these pressures, directional drilling is being applied in situations where it has not been common in the past. These new applications have caused well bore trajectories to become increasingly more complex.

The location of the trajectory of a well bore is determined by computing catesian coordinates from a set of curvilinear coordinates defined by a set of survey stations at various depths in the earth. Each survey station comprises of a measured depth from surface, an inclination, and an azimuth at a location along a well path. To convert information taken at survey stations into a well path in terms of curvilinear coordinates some method is implemented which makes a set of assumptions about the well path. The set of assumptions are related to the well path between the survey stations. Several methods related to processing a well plan have been used to date including average angle, tangential, balanced tangential, Mercury, radius of curvature, and minimum curvature. Only the radius of curvature method and the minimum curvature method produce a path that is acceptable for highly directional wells.

In recent years, well plans have become much more complex due to the reduction in technological limitations which have made such well plans difficult if not impossible to drill using previous or conventional technologies. The complexity of these designer wells has forced well planners to use planning tools that are in turn becoming more and more complex.

Today, well planning is typically done by tying together a series of curve and hold sections using a spreadsheet on which each row represents an individual section of the well. The trajectory planning workflow is usually done by adding sections, plotting the sections, editing numbers on the spreadsheet, and again plotting the sections. This procedure is done repeatedly until well planners obtain a satisfactory trajectory. With the ever increasing three dimensional (3D) nature of wells and the necessity to avoid existing wells, there remains a need for a new well planning method that can create, manipulate and edit well plans. One such method can be a new graphical method that can create and edit well plan trajectories in order to achieve an optimal plan more quickly and more effectively than is done today.

Many software products exist today to plan wells using a spreadsheet like interface. These programs include Rodan, Drilling Office, WellPlan, and SysDrill. Rodan is a graphical well planning program that allows the user to modify individual sections of a well, but it basically modifies the sections on the spreadsheet graphically. Even though these products have the capability to plan wells, there still remains a need for a well planning method that can enable a user to modify multiple sections of a well plan at once in an intuitive manner. The present method can address this need The method described herein is different in that the user can modify many sections of the well plan at once instead of modifying the well section by section. This method allows the user to very quickly create and modify a well for their specific needs.

SUMMARY OF THE INVENTION

It is an objective of the present invention to provide a method and display for graphically planning the trajectory of a well bore.

It is a second objective of the present invention to provide a method and display for graphically planning a well trajectory using control points that do not lie on the well plan.

It is a third objective of the present invention to provide a method and display for graphically modifying the trajectory of a well plan by manipulating the location of one or more coordinates that are related to one section of a well.

It is a fourth objective of the present invention to provide a method and display that can graphically determine the trajectory of a well plan based on the modification of one section of the well plan.

It is a fifth objective of the present invention to provide a method and display that can manipulate the position of all sections of a well plan by modifying points that lie on and off of the well plan.

It is a sixth objective of the present invention to provide a graphical well planning method and display that can manipulate multiple sections simultaneously to reflect the impact to the modification of one section of the well plan on the entire well plan.

The present invention provides a graphical method and display to design and modify the trajectory of a well bore. A well bore trajectory plan comprises hold (straight) and curve sections. Hold sections are generally described by specifying the attitude and length of the hold section. Curve sections can be described and represented in a variety of ways. One way is by specifying the starting attitude, the ending attitude and the curve length. The actual path of the curve section is generally dependent on the computation method used to describe the section. Two common methods of computing curves are the minimum curvature method and the radius of curvature method. In the minimum curvature method, curve sections have a constant radius of curvature. The preferred method of the present invention assumes curves are computed using minimum curvature.

The method of the present invention positions points at locations off of the well plan for each curve section where lines which are tangent to each respective curve section and which extend from the points at the start and end of each curve section intersect. These points are referred to as control points. For each curve, the distance along the lines from the control point to tangent points of the curve sections is always equal if the curvature is constant. By manipulating the control point and keeping the curvature of the curve section constant, at least three sections of a well plan (two hold section and the connecting curve section) can be manipulated at the same tine. When curve sections precede or follow the first or last hold section, respectively, up to five sections (curve, hold, curve, hold, curve) can be manipulated simultaneously. By just moving a control point in 2D or 3D space, the attitude of the both hold sections can change, and the lengths all of the sections of a well plan can be altered. Many aspects of the well plan can be quickly changed using the control points as described in the present invention.

In operation, the control points can be manipulated in certain pre-determined directions. Since the different sections of the well plan are connected, movement of one section can alter the sections adjacent to the modified section. Modification of multiple sections can enable well planners to quickly model the path of an entire well bore instead of a section-by-section approach.

In addition to modifying the well plan with movement of a control point, there are three additional items that can be graphically modified to manipulate the well plan. These items are the starting point and ending point of the plan and the curvature of the curve sections.

DETAILED DESCRIPTION OF THE INVENTION

Figure 1:
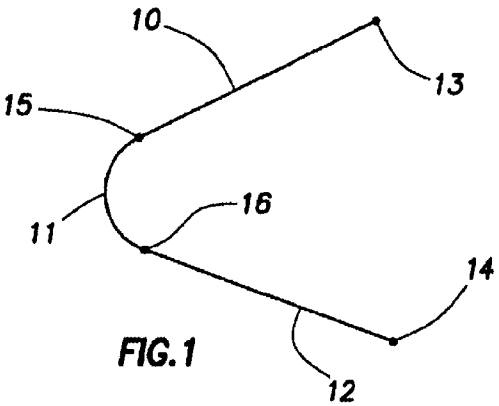
FIG. 1 is an illustration of the hold and curve sections of a well plan.
Figure 2:
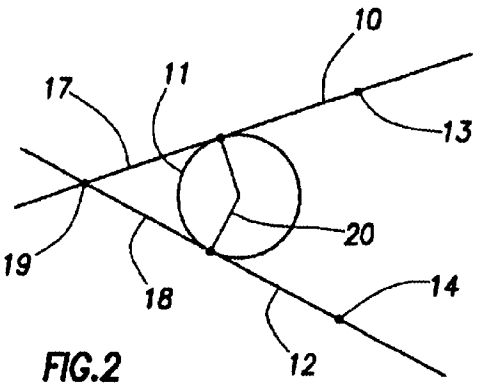
FIG. 2 is an illustration of a hold, curve, and hold well plan with points used for graphical manipulation of the well plan.

FIG. 1 shows a simple three section well plan. As shown, this well plan has a straight section 10 called a hold section, a curve section 11, and a second hold section 12. The well plan has a starting point 13 and an ending point 14. The starting point 13 is at the top end of the first hold section 10. The end point 14 is at the end of the second hold section 12. The well plan also has tangent points 15 and 16 at the points where each hold section meets the curve section 11. The curve section 11 is a circular arc with a radius that is inversely proportional to the curvature of the curve. Each hold section lies on a line. By examining the lines, 17 and 18, on which the hold sections lie, as is shown in FIG. 2, an intersection point will occur at point 19 off the well plan. This intersection point 19 is defined as the control point. The distance along the lines from the control point 19 to the tangent points on the curve 15 and 16 is always equal if the radius 20 of the curve section is constant. By manipulating the control point 19 (moving it in defined directions) and keeping the radius 20 of the circle forming the curve section 11 constant, all three sections 10, 11 and 12 can be manipulated at the same time. Conventional methods can only manipulate one section at a time.

Figure 3:
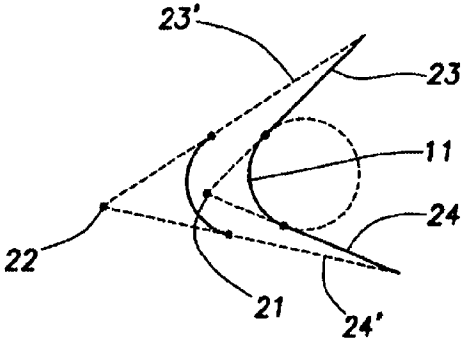
FIG. 3 illustrates the effect of moving a control point on a well plan.

With movement of the control point, one can quickly change many aspects of the well plan. By just moving one of the control points in 2D or 3D space, the attitude of the hold sections can change, and the lengths all of the sections can be altered. FIG. 3 illustrates that impact of the movement of a control point on the trajectory of a well plan. As shown, there is a slight movement of the control point 21 to location 22. As the control point is moved from 21 to 22, there is a change in the directions of hold sections 23 and 24 to positions 23' and 24'. By moving the control point to a new position and keeping the radius of the curve section constant, the direction and length of the hold sections has changed and therefore there is a change in the shape of the well plan trajectory. The movement of the control point causes both hold sections 23 and 24 to be altered simultaneously. In addition to altering the hold sections, the location and length of the curve section 11 can change with the movement of the control point.

The key to the alteration of the various sections of the well plan when there is movement of the control point is in the requirement that the distance of the tangent points from the control point to the curve section be the same distance. If movement of the control point is not along one of the hold section directional lines, while the distance between the tangent points and control points remains constant, the direction (angle) of the two hold sections change. The movement of the control point can be in a direction such that in order to maintain the distance requirements between the tangent points and the control point, the curve section will need to rotate. This rotation will cause the direction of the adjoining hold sections to change. In practice, the movement of the hold and curve sections occur simultaneously and are interdependent. In the method of the present invention, movements are calculated based the previously mentioned distance requirements between the tangent points and control point.

Figure 4:
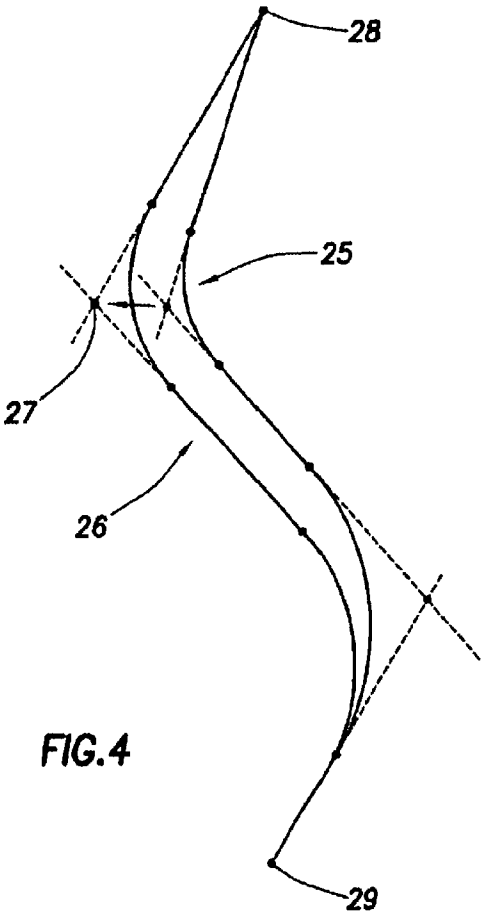
FIG. 4 illustrates a larger well plan showing the effect of moving a control point on a well plan.

FIG. 4 illustrates an original well plan 25 and an altered well plan 26 after movement of control point 27. The movement of the control point caused a change in all sections of the well plan in FIG. 4. The only locations not affected were the starting point and ending point, 28 and 29, respectively, and the attitude of the hold section connected to the end point 29. The well plan 26 illustrates the effects of the manipulation of one control point of the well plan on the other sections of the well plan.

As previously mentioned and referring to FIG. 2, by manipulating the control point 19, starting point 13, end point 14 and keeping the radius 20 of the circle forming the curve section 11 constant, there can be a quick manipulation of all three sections 10, 11 and 12 of the well plan at the same time. In the manipulation of the control point, movement constraints can exist upon of the control point depending on whether the starting point or end point are fixed. There are three constraint cases to consider in the movement of the control point.

Figure 5:
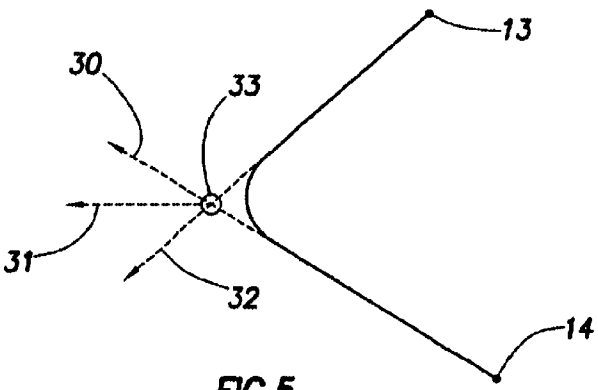
FIG. 5 illustrates the constraints on the movement of the control points.

Case 1 is the directionless end point. This case is illustrated in FIG. 5. If at the starting point (S) 13 and the end point (E) 14 there are no directional constraints, then there is are no constraints on control point (C) and it has three degrees of freedom 30, 31, and 32 in which to move.

Case 2 is when there is a constraint on one directed end point (e.g. the case of planning from a well head). If a directional constraint exists at S (13), then the control point can only be moved on the line segment staring at S in the direction 32. This movement is described in the following equation:

$$C=v\xi+S, \text{ where } \xi>0 \quad (1)$$

where C only has one degree of freedom, $\xi$, and v is a vector describing the direction of the line segment 32. This constraint is similar if the directional constraint exists at E.

In Case 3, both starting and end directions are constant (e.g. modifying a section in the middle of a plan). Therefore, the control point cannot be moved in any direction. The movement of C has zero degrees of freedom in this case.

Referring back to FIG. 2, for the small three section well plan there are four items that can be modified to manipulate the well plan. These items are the starting point 13 (S), the ending point 14 (E), the control point 19 (C) and the radius 20 of the circular arc (R) forming the curve section. Graphically, it is not intuitive to manipulate the radius of the curve section. Instead, tangent points can be moved along the lines 17 or 18 to manipulate the radius. In practice, if either tangent point (T) is moved along the lines defining the control point, the radius of the arc is altered. In addition, when S, C, and E are on the same line, the well plan section reduces to a hold or straight section.

Figure 6:
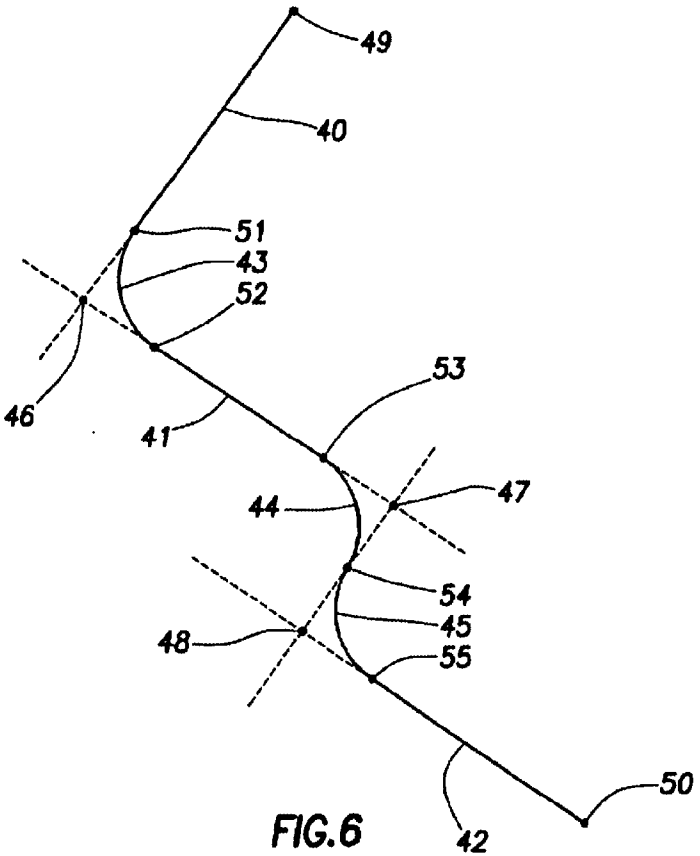
FIG. 6 illustrates a larger well plan with all control points, tangent points, stating point and end point.

Each curve section in a well plan requires one and only one control point. More control points can be introduced in the well plan when there is an addition of more curve-hold sections to the well plan. When more sections are added to the well plan, as shown in FIG. 6, more control points and tangent points are added to the well plan as variables. FIG. 6 shows the control points, radii and starting and ending points of a well plan with three curve sections. This well plan also contains multiple hold sections 40, 41 and 42 and curve sections 43, 44 and 45. Control points $C_{i-1}$ 46, $C_i$ 47, and $C_{i-1}$ 48 extend from each curve sections 43, 44 and 45 respectively. Each curve section has tangent points. Curve section 43 has tangent points 15 and 52. Curve section 44 has control points 53 and 54. Curve 45 has tangent points 54 and 55. Graphically, the starting and ending points, S 49 and E 50, can be manipulated to modify a plan subject to the above-given constraints. The manipulation of the control points makes the manipulation of the well plan much simpler. At 54 two curve sections are connected without a hold section. At this point the line on which the control points lie is through the tangent points of the two curve sections.

Figure 7:
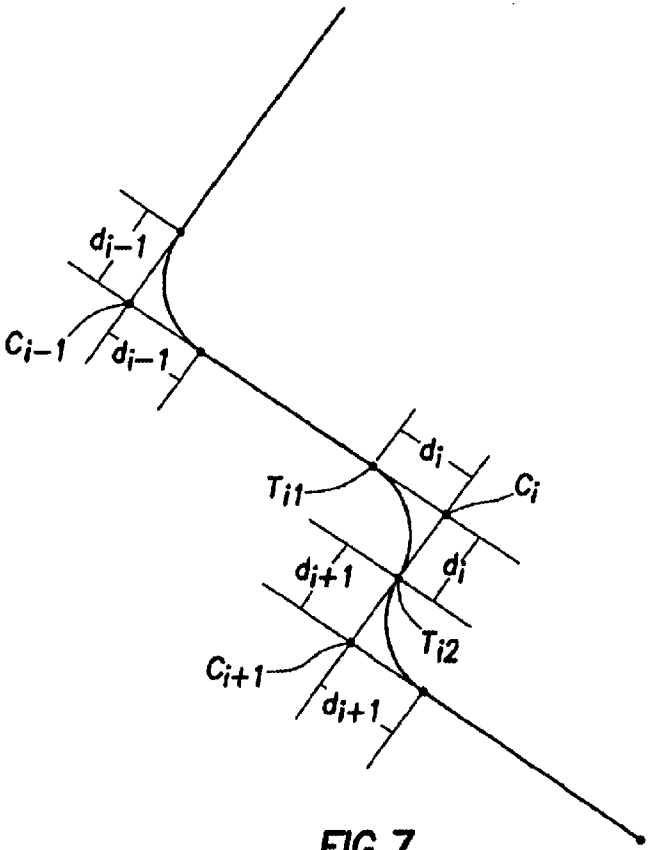
FIG. 7 illustrates the constraints on the movement of the tangent points.

The movement of control points 46, 47 and 48 is according to the previously described control point directional constraints. The movement of tangent points can be illustrated using the well plan shown in FIG. 6. The movement of the tangent points for each curve section is constrained to be along the lines connecting adjacent control points. Referring to FIGS. 6 and 7, assume a trajectory connecting S 49 and E 50 is controlled by control points $C_{i-1}$ 46, $C_i$ 47 and $C_{i+1}$ 48. For each control point, such as $C_i$ there are two tangent points $T_{i1}$ 3 and $T_{i2}$ 54. The distance between $C_i$ and $T_{i1}$ or $T_{i2}$ is defined as $d_i$ and is calculated using the following formula, $$d_i = R_i/\tan(\alpha_i/2), \tag{2}$$

where $\alpha_i$ is angle $C_{i-1}C_iC_{i+1}$. Tangent point $T_{i1}$ must lie on the line segment from $C_{i-1}$ to $C_i$ and tangent point $T_{i2}$ must lie on the line segment from $C_i$ to $C_{i+1}$. The movement of tangent point $T_{i1}$ can only be along the $C_{i-1}C_i$ line segment. The movement of $T_{i1}$ is subject to the following condition, $$d_i + d_{i-1} <= |C_{i-1}C_i| \tag{4}$$

and, $$d_{i+1} + d_i <= |C_iC_{i+1}|. \tag{4}$$

To move beyond minimum curvature for the curve computations, one could assume that the curve does not maintain a constant radius of curvature. This would allow for varying rates of curvature through each curve section. Planning this type of well is a simple extension of this graphical method and only slightly modifies the above equations 2–4.

The method of this invention can be implemented using a conventional data processing system. The data processing system includes processor that preferably includes a graphics processor, memory device and central processor (not shown). Coupled to processor is video display, which may be implemented utilizing either a color or monochromatic monitor, in a manner well known in the art. Also coupled to processor is keyboard. The keyboard preferably comprises a standard computer keyboard, which is coupled to the processor by means of cable. Also coupled to processor is a graphical pointing device, such as mouse. The mouse is coupled to processor, in a manner well known in the art, via cable. While the disclosed embodiment of the present invention utilizes a graphical pointer, those skilled in the art will appreciate that any other pointer device such as a light pen or touch sensitive screen may be utilized to implement the method and apparatus of the present invention. Upon reference to the foregoing, those skilled in the art will appreciate that data processing system may be implemented utilizing a personal computer.

Figure 8:
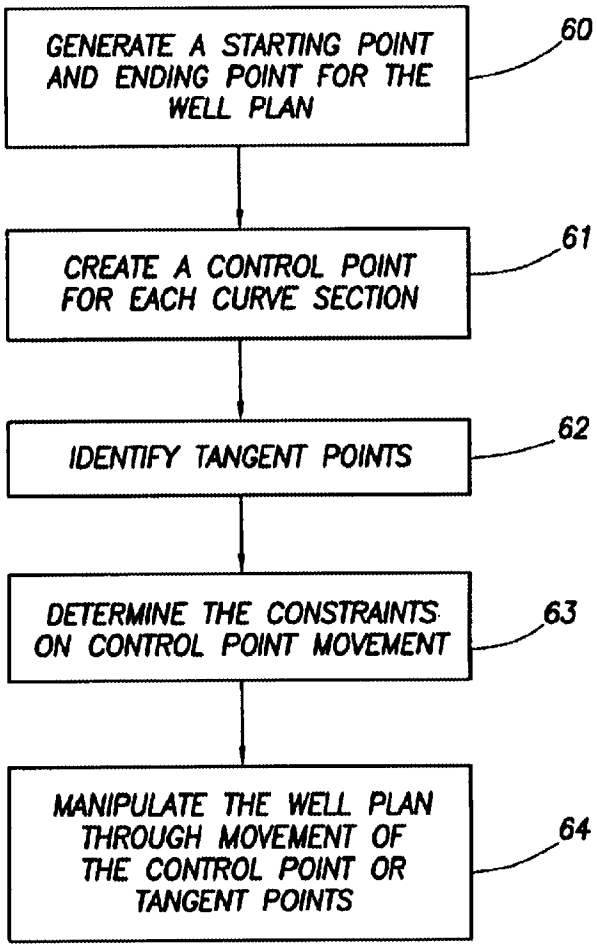
FIG. 8 shows a flow diagram of the steps involved in manipulating the control points and altering a well plan in the present invention.

FIG. 8 shows the general steps in the implementation of the invention. The initial step 60 of the present invention is to generate the starting and ending point of the well plan trajectory. Conventional technology is available that can create this initial well plan. Step 61 generates a control point for each curve section of the well plan. As previously discussed, the control point lies off of the well plan and is generated from the intersection of extensions of the hold sections adjacent to a curve section. Step 62 identifies tangent points located where hold sections contact a common curve section. The next step 63 is to determine the constraints on movement of the control point. In step 64, the user can manipulate the well plan through movement of the control point. As previously mentioned, in the preferred embodiment, the radius of the curve section remains constant. As the control point moves, graphical software calculates the positions of the different well plan sections based on the relationship between the control point and the tangent points. In this manner multiple sections of the well plan can be modified simultaneously and the results of the modifications displayed to the user.

Various sets of values can be used to represent a well plan. For graphical well planning to make the manipulation as simple and as intuitive as possible, the choice of the optimal set of values is critical. The invention described herein chooses values that are best suited to graphical well planning. These values are not obvious because some of these values (control points) do not lie on the actual well plan, and they allow a greater simplification to the well planning process than what has typically been done in past well planning processes. The method of this invention removes many problem associated with propagation of changes through a well plan as well as problems with defining sections individually and tying these sections together.

The methods of this invention provide significant advantages over the current art. The invention has been described in connection with its preferred embodiments. However, it is not limited thereto. Changes, variations and modifications to the basic design may be made without departing from the inventive concepts in this invention. In addition, these changes, variations and modifications would be obvious to those skilled in the art having the benefit of the foregoing teachings. All such changes, variations and modifications are intended to be within the scope of this invention, which is limited only by the following claims.

We claim:

1. A method for planning the direction and inclination of a well bore trajectory using graphical techniques comprising the steps of:

generating an initial starting point and ending point for a well bore trajectory, the well trajectory having hold and curve sections;

creating a control point for each desired curve section between the starting point and ending point, said control points being at locations off said curve section;

identifying tangent points along the well bore trajectory where the hold sections contact a curve section of the trajectory;

determining any directional constraints on the ability to manipulate the control point; and graphically manipulating multiple sections of the well bore trajectory simultaneously by graphical directional movement of points related to the well bore trajectory within said determined directional constraints.

2. The method as described in claim 1 wherein said graphical manipulation comprises directional movement of control points.

3. The method as described in claim 1 wherein said graphical manipulation comprises directional movement of identified tangent points.

4. The method as described in claim 1 wherein said graphical manipulation comprises directional movement of control points and identified tangent points.

5. The method as described in claim 1 wherein said control point creating step comprises projecting each hold section contacting a curve section beyond the tangent points in the direction of hold section such that the projections of the bold sections intersect and form-a control point for that contacted curve section at the intersection point of the hold section projections.

6. The method as described in claim 1 wherein said directional movement constraints determination step is determined by $$C=v\xi+S, \text{ where } \xi>0$$

where C is a control point, S is a starting point, v is a vector extending from S, and ξ is a scalar distance, further where C only his one degree of freedom.

7. The method as described in claim 6 wherein said direction constraints determination step determines that there are no directional movement constraits on the control point, thereby enabling movement of the control point in any direction.

8. The method as described in claim 1 wherein said graphical manipulation of the well bore trajectory further comprises manipulating multiple sections of the trajectory by moving a control point while maintaining a constant radius of the curve section corresponding to that control point.

9. The method as described in claim 3 wherein the manipulation of the curve section comprises moving the points along the projected hold section lines.

10. The method as described in claim 9 wherein said well plan further comprises multiple curve sections, connected by hold sections, said well plan also have a control point at each curve section, and wherein tangent point manipulation is constrained to movement of the tangent points along directional lines that connect adjacent control points.

11. The method as described in claim 10 wherein the movement of a tangent point cannot extend passed an adjacent control point or tangent point.

12. A computer program product in a computer readable medium for graphically planning the direction and inclination of a well bore trajectory using graphical techniques comprising:

instructions for generating an initial starting point and ending point for a well bore trajectory, the well trajectory having hold and curve sections; instructions for creating a control point for each desired curve section between the starting point and ending point, said control points being at locations off said curve section;

instructions for identifying tangent points along the well bore trajectory where hold sections contact a curve section of the trajectory;

instructions for determining any directional constraints on the ability to manipulate the control point; and instructions for graphically manipulating multiple sections of the well bore trajectory simultaneously by graphical directional movement of points related to the well bore trajectory within said determined directional constraints.

13. The computer program product as described in claim 12 wherein said directional movement constraints determination instructions further comprise instructions for determining movement constraints using $$c=v\xi+S, \text{ where } \xi>0$$

where control point C only has one degree of freedom, and ξ and v is a vector describing the direction of the one degree of freedom.

14. The computer program product as described in claim 13 wherein said control point creating instructions further comprise instructions for projecting each hold section beyond the tangent points in the direction of hold section such that the projections of the hold sections that are tangent to a common curve section intersect and form a control point for that curve section at the intersection point of the hold section projections.

15. The computer program product as described in claim 12 wherein said graphical manipulation of the well bore trajectory instruction further comprises instructions for manipulating multiple sections of the trajectory by moving a control point while maintaining a constant radius of the curve section corresponding to that control point.

16. The computer program product as described in claim 12 further comprising instructions for manipulation of the well bore trajectory using the identified tangent points.

17. The computer program product as described in claim 15 wherein the manipulation of the curve section instructions further comprise instructions for moving the tangent points along the hold section lines.

18. A graphical well bore trajectory display capable of real-time graphical manipulation comprising:

an initial hold section at the stating point of the well bore trajectory;

a curve section connected to said initial hold section;

a second hold section connected to said curve section; and a control point positioned a location of the well bore trajectory, to enable simultaneous graphical manipulation of said hold and curve sections of the well bore.

19. The graphical well bore trajectory display as described in claim 18 wherein said well bore display further comprises:

a starting point at the initial hold section;

an end point at the end of said second hold section; and tangent points at points where the hold sections intersect the curve sections.

20. The graphical well bore trajectory display as described in claim 19 wherein the radius of the curve section remains constant during graphical manipulation of the well bore trajectory.

21. The graphical well bore trajectory display as described in claim 19 wherein the distance from each tangent point of a curve section to said control point for that curve section is equal.

22. The graphical well bore trajectory display as described in claim 18 wherein a said control point for a curve section is formed at the intersection of projections of said hold sections that connect to the curve section.

23. The graphical well bore trajectory display as described in claim 18 further comprising multiple curve sections in the trajectory, each said curve section having corresponding tangent points and a corresponding control point.

24. The graphical well bore trajectory display as described in claim 23 further comprising hold sections between said multiple curve sections, a said hold connecting two curve sections.

25. The graphical well bore trajectory display as described in claim 23 wherein a pair of said curve sections is directly connected at a tangent point common width curve sections.

26. The method of claim 1, further comprising:

associating at least one control point with multiple tangent points for corresponding curve sections, wherein manipulation of one of the control or tangent points causes manipulation of the associated control and tangent points.

27. The computer program of claim 12, further comprising:

instructions for associating at least one control point with multiple tangent points for corresponding curve sections, wherein manipulation of one of the control or tangent points causes manipulation of the associated control and tangent points.

* * * * *